US007686262B2

(12) United States Patent
Pierce

(10) Patent No.: US 7,686,262 B2
(45) Date of Patent: Mar. 30, 2010

(54) ARCHERS CADDIE

(76) Inventor: Phillip F. Pierce, 132 Cedar Grove Pkwy., Maylene, AL (US) 35114

( * ) Notice: Subject to any disclaimer, the term of this patent is extended or adjusted under 35 U.S.C. 154(b) by 260 days.

(21) Appl. No.: 11/907,778

(22) Filed: Oct. 17, 2007

(65) Prior Publication Data

US 2008/0121540 A1 May 29, 2008

Related U.S. Application Data

(60) Provisional application No. 60/861,448, filed on Nov. 29, 2006.

(51) Int. Cl.
*F16M 11/00* (2006.01)

(52) U.S. Cl. ..... 248/176.1; 42/94; 211/60.1; 124/25.7

(58) Field of Classification Search ..... 248/122.1, 248/176.1; 42/94; 211/60.1, 64, 84.7; 124/25.7, 124/23.1, 86
See application file for complete search history.

(56) References Cited

U.S. PATENT DOCUMENTS 3,584,820 A 6/1971 Butcher
4,474,296 A * 10/1984 Hartman ..... 211/85.7
4,957,229 A 9/1990 Freeman
5,121,890 A * 6/1992 Komada ..... 248/122.1
D375,993 S * 11/1996 Skinnes ..... D22/107
D379,399 S * 5/1997 Reinaker ..... D22/113
5,983,879 A 11/1999 Gifford
6,305,117 B1 * 10/2001 Hales, Sr. ..... 42/94

* cited by examiner

*Primary Examiner*—Amy J Sterling
(74) *Attorney, Agent, or Firm*—Richard C. Litman

(57) ABSTRACT

An archer's caddie includes a portable, freestanding quiver and bow support. The caddie is fabricated from solid plastic parts, which parts are attached with metal fasteners. The upper end of the caddie terminates in a padded bow support. A removable beverage holder can be disposed at two positions on the caddie. An array of receptacles is provided for containing accessories such as conventional arrows, crossbow bolts, shooting gloves, quick release, pencils, markers, etc. A base member defines the lower end of the caddie. The base member is weighted and designed with bent feet to enhance stability when the caddie is positioned on uneven surfaces.

10 Claims, 5 Drawing Sheets

ARCHERS CADDIE

CROSS-REFERENCE TO RELATED APPLICATION

This application claims the benefit of U.S. Provisional Patent Application Ser. No. 60/861,448, filed Nov. 29, 2006.

BACKGROUND OF THE INVENTION

1. Field of the Invention

The present invention generally relates to support structure. More specifically, the present invention is drawn to a portable caddie for supporting archery paraphernalia.

2. Description of the Related Art

When target shooting, an archer often must lay down his/her bow and arrows for a brief rest. During this rest period, the archer may need to partake of a refreshing drink and/or record data relative to the practice target location. Placing the archery equipment on the ground can be inconvenient in that the ground may be muddy and soil the equipment. Furthermore, the equipment is more likely to be damaged because of an inadvertent step. The art would certainly welcome apparatus that would support the archery equipment in a safer and more accessible manner while also providing an ancillary support for a beverage receptacle and for pencils, notepads and the like. Thus, an archer's caddie solving the aforementioned problems is desired.

SUMMARY OF THE INVENTION

The archer's caddie is a portable, freestanding quiver and bow support. As presently contemplated the caddie will be fabricated from solid plastic parts, which parts are attached with metal fasteners. It is obvious however, that other suitable materials can be utilized if desired. The upper end of the caddie terminates in a padded bow support. A removable beverage holder can be disposed at two positions on the caddie. An array of receptacles is provided for containing accessories such as conventional arrows, crossbow bolts, shooting gloves, quick release, pencils, markers, etc. A base member defines the lower end of the caddie. The base member is weighted and designed with bent feet to enhance stability when the caddie is positioned on uneven surfaces.

Accordingly, the invention presents a caddie that can be used by all archery shooters. The caddie will accommodate Long Bows, Recurve Bows, Compound Bows and Crossbows. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
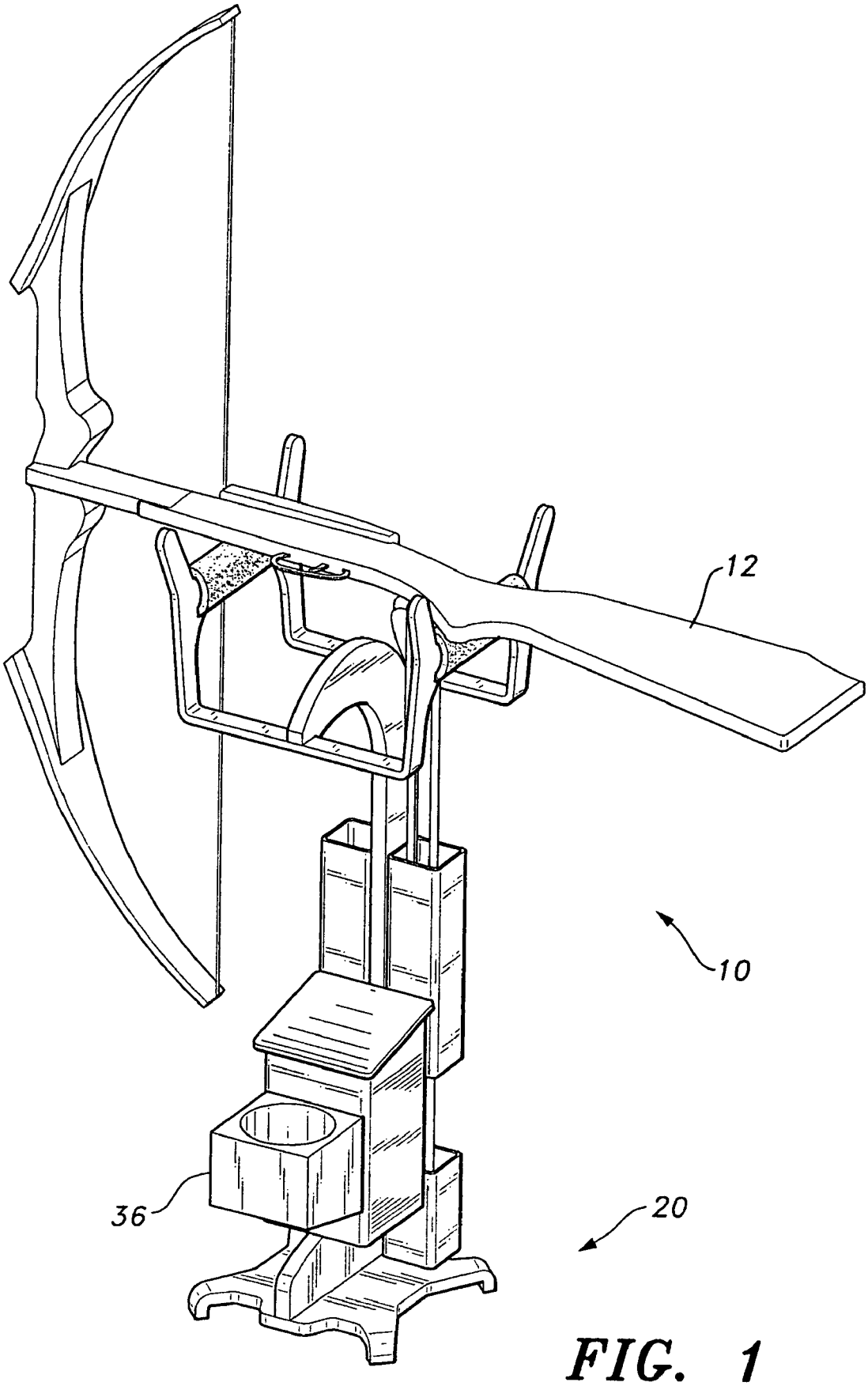
FIG. 1 is an environmental, perspective view of an archer's caddie according to the present invention.
Figure 2:
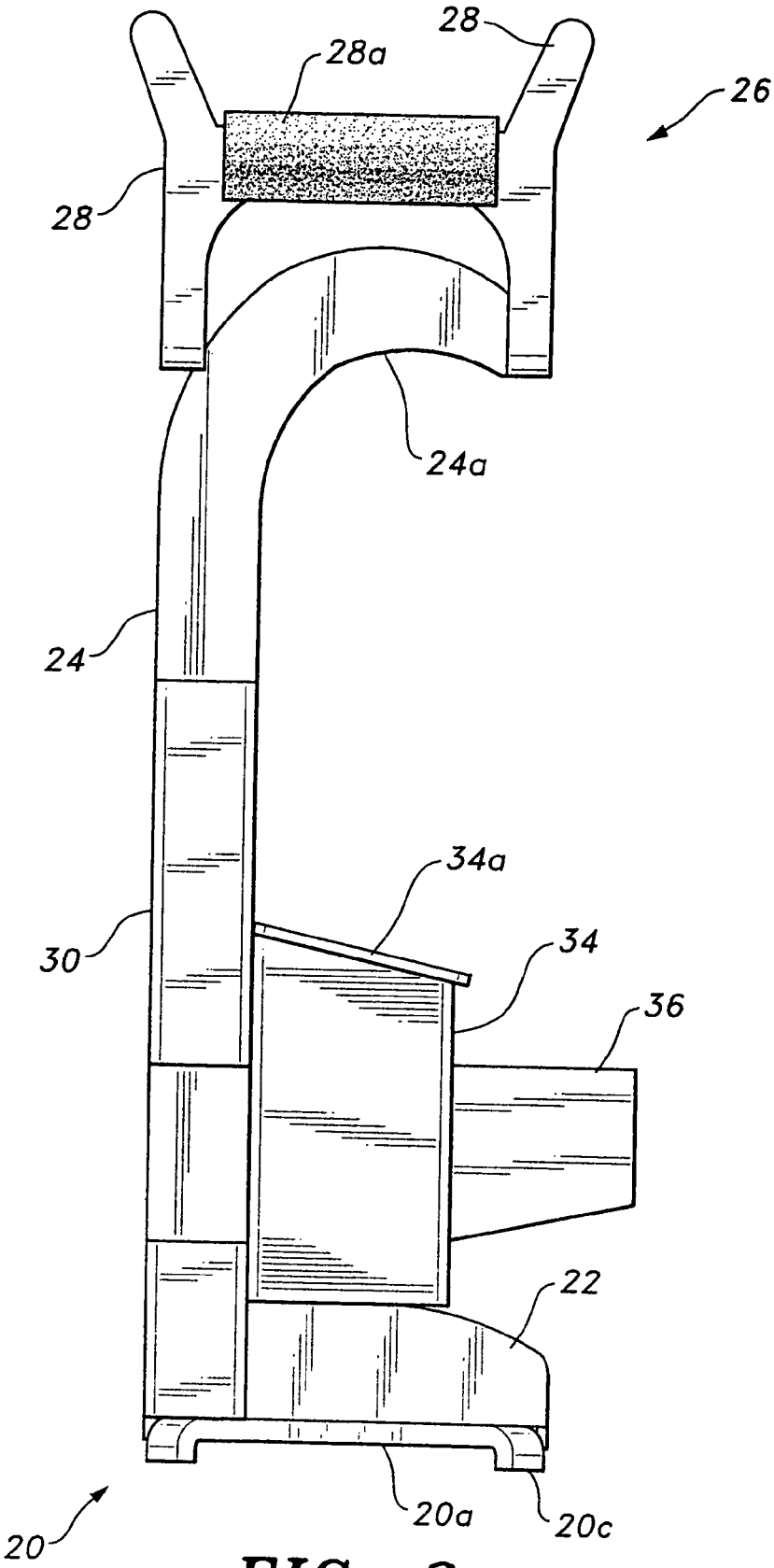
FIG. 2 is a side view of an archer's caddie according to the present invention.
Figure 3:
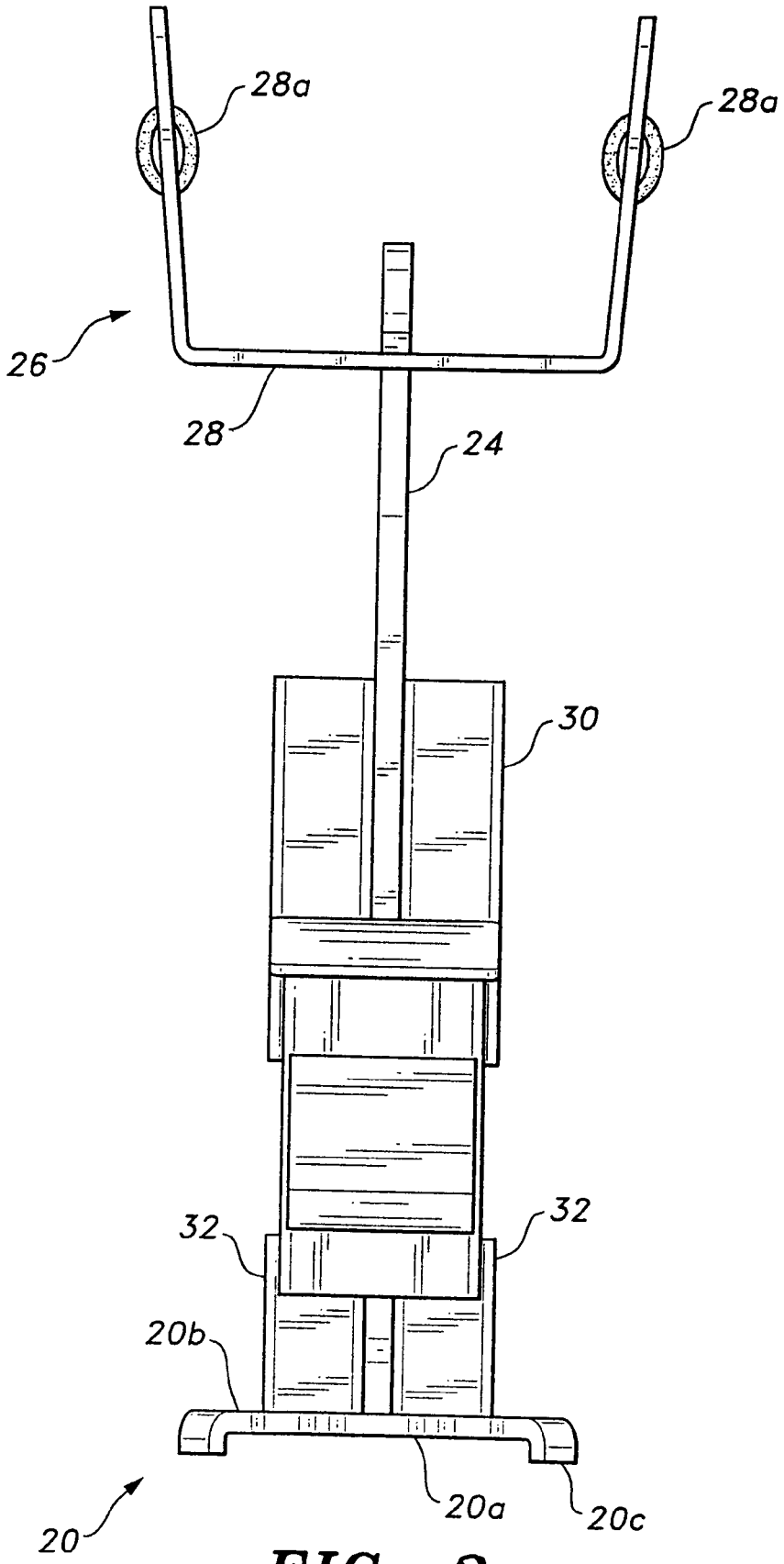
FIG. 3 is a front view of an archer's caddie according to the present invention.
Figure 4:
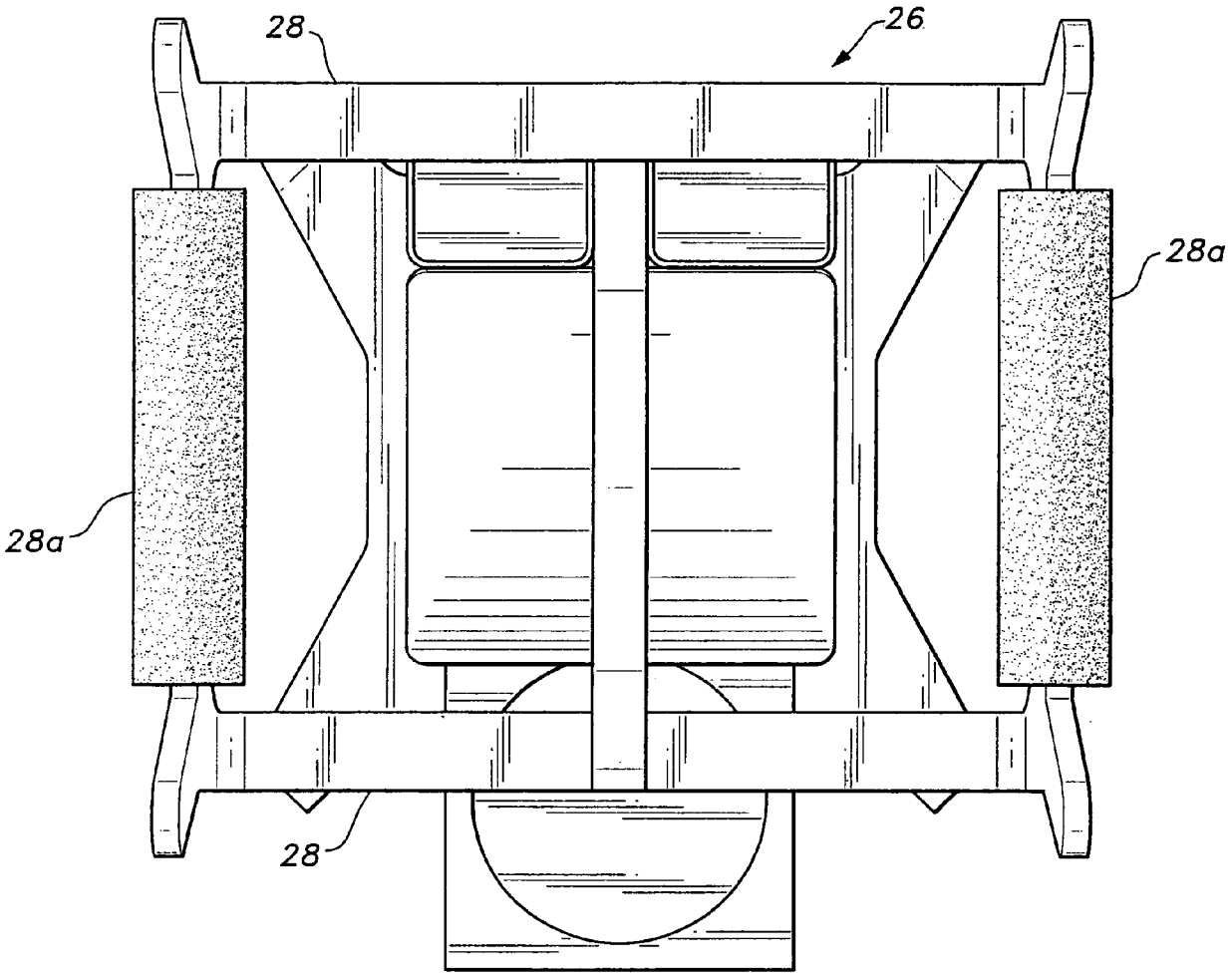
FIG. 4 is a top view of an archer's caddie according to the present invention.
Figure 5:
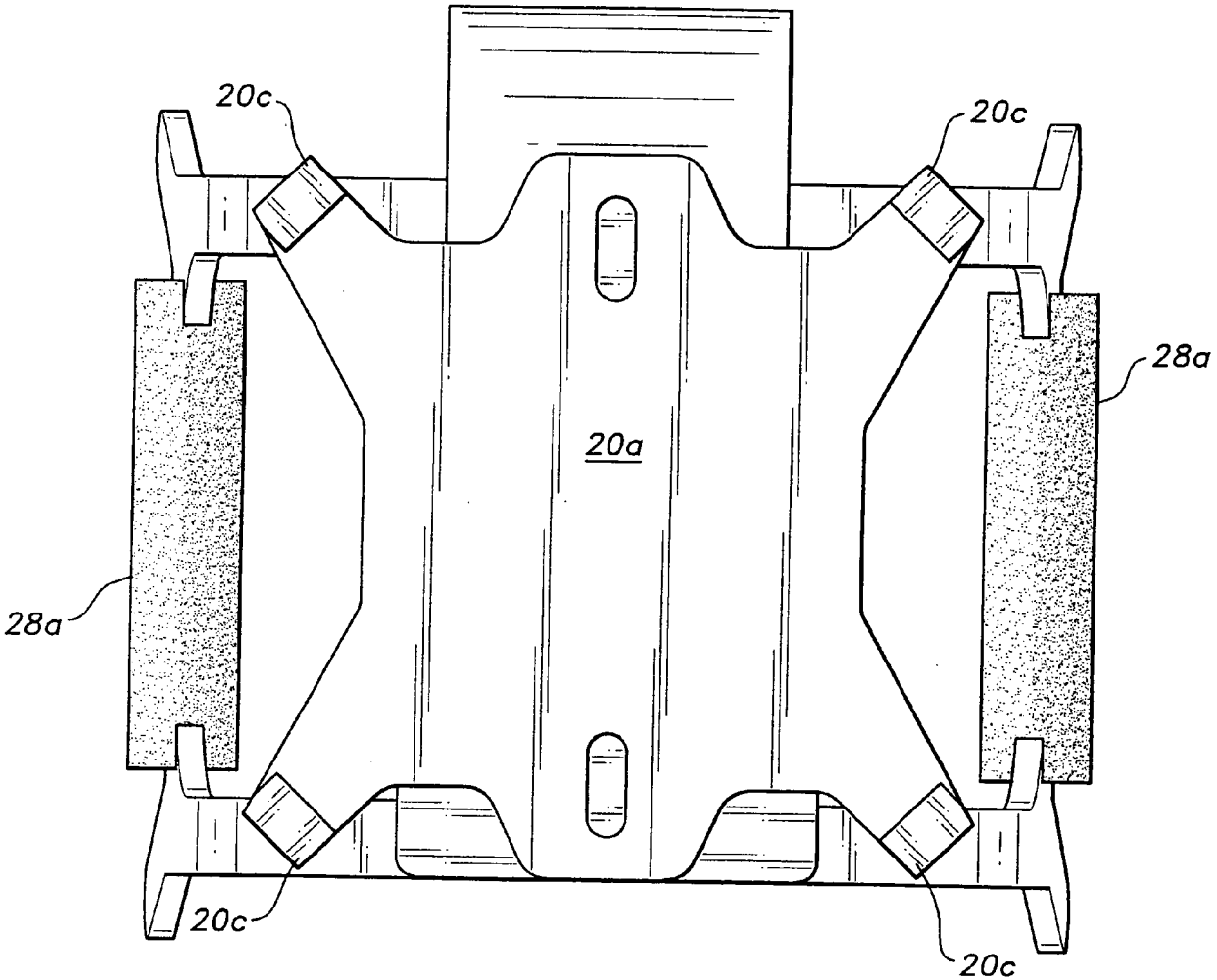
FIG. 5 is a bottom view of the base of an archer's caddie according to the present invention.

Attention is first directed to FIG. 1, wherein the archer's caddie of the present invention is generally indicated at 10. As illustrated, the caddie is shown supporting a crossbow 12. However, as indicated above, any type bow can be supported on caddie 10.

As best seen in FIGS. 2-5, the main structural components of the caddie comprise a base 20, gusset member 22, a vertically positioned support 24, a gear box 34, an arrow receptacle 30, a beverage container 36 and a bow support 26. Base 20 has a lower face 20*a* and an upper face 20*b*. Plural feet 20*c* depend from lower face 20*a* to support base 20 from a supporting surface such as the ground. Feet 20*c* are integrally formed with base 20. Gusset member 22 is disposed on the upper face 20*b* and is attached thereto. Vertical support 24 has a lower end attached to gusset member 22 and terminates in a curved upper end 24*a*. Bow support 26 comprises two U-shaped members 28 that are spaced apart and connected by padded support arms 28*a*. The base of each U-shaped member 28 is designed to interlock with the curved upper end 24*a*. A receptacle 30 is attached to vertical support 24. Receptacle 30 is adapted to contain arrows. Additional receptacles 32 house other desired paraphernalia. A gear box 34 having a hinged lid 34*a* is provided to house equipment in a non-exposed environment. A beverage container 36 can be interlocked with gear box 34 or alternatively, attached to receptacle 30 if desired, whereby the beverage container is indirectly supported on the support 24. All components are designed to interlock or attached with fasteners (not shown). The components can easily be assembled and unassembled to provide a high degree of portability.

It is to be understood that the present invention is not limited to the embodiment described above, but encompasses any and all embodiments within the scope of the following claims.

I claim:

1. An archer's caddie, comprising:

a base member having an upper face and a lower face;

a gusset member supported on the upper face of said base member, said gusset member being vertically disposed on said base member and defining a first plane;

a vertical support member having a lower end attached to said gusset member, said vertical support member having a curved upper end, wherein said vertical support member and said curved upper end are substantially coplanar with said first plane;

a bow support member positioned on the curved upper end of said vertical support member, said bow support member having a pair of spaced-apart U-shaped members, wherein said U-shaped members define spaced apart parallel planes substantially transverse to said first plane; and a pair of arms connecting said pair of spaced-apart U-shaped members, wherein said arms define spaced apart parallel planes substantially parallel to said first plane.

2. The archer's caddie according to claim 1, further including a receptacle for containing arrows attached to said vertical support member above said base.

3. The archer's caddie according to claim 1, further including a gear box attached to said vertical support member.

4. The archer's caddie according to claim 1, further including a beverage container indirectly supported on said vertical support member.

5. The archer's caddie according to claim 1, further including a plurality of support feet extending from the lower face of said base.

6. An archer's caddie, comprising:

a base member having an upper face and a lower face;

a gusset member supported on the upper face of said base member; said gusset member being vertically disposed on said base member and defining a first plane;

a vertical support member having a lower end attached to said gusset member, said vertical support member having a curved upper end, wherein said vertical support member and said curved upper end are substantially coplanar with said first plane;

a bow support member positioned on the curved upper end of said vertical support member, said bow support member having a pair of spaced-apart U-shaped members, wherein said U-shaped members define spaced apart parallel planes substantially transverse to said first plane;

a pair of padded arms connecting said pair of spaced-apart U-shaped members, wherein said padded arms define spaced apart parallel planes substantially parallel to said first plane;

a first receptacle for containing arrows attached to said vertical support member above said base; and a plurality of additional receptacles supported on said base below said first receptacle.

7. The archer's caddie according to claim 6, further including a gear box attached to said vertical support member.

8. The archer's caddie according to claim 6, further including a gear box attached to said vertical support member, said gear box having an open top and including a lid attached to said gear box for selectively closing the open top.

9. The archer's caddy according to claim 8, further including a plurality of support feet extending from the lower face of said base.

10. The archer's caddie according to claim 6, further including a beverage container indirectly supported on said vertical support member.

* * * * *